United States Patent [19]

Yashima

[11] Patent Number: 4,790,288

[45] Date of Patent: Dec. 13, 1988

[54] THEMOSTATIC OVEN

[75] Inventor: Minoru Yashima, Tokyo, Japan

[73] Assignee: Yashima Works, Ltd., Tokyo, Japan

[21] Appl. No.: 100,109

[22] Filed: Sep. 23, 1987

[51] Int. Cl.[4] ..... F23M 7/00

[52] U.S. Cl. ..... 126/190; 110/173 R; 160/120; 432/250

[58] Field of Search ..... 126/190, 192, 198, 200; 110/172, 173 R, 176; 432/237, 250; 160/120, 121 R, 121 C, 122; 312/291

[56] References Cited

U.S. PATENT DOCUMENTS 260,094 6/1882 Hankins ..... 126/190
675,955 6/1901 Kinnear ..... 160/121 R
4,194,550 3/1980 Hopper ..... 160/121 R
4,408,650 10/1983 Verch ..... 160/121 R

FOREIGN PATENT DOCUMENTS 2308074 12/1973 Fed. Rep. of Germany ... 110/173 R

*Primary Examiner*—Samuel Scott
*Assistant Examiner*—Noah Kamen
*Attorney, Agent, or Firm*—Michael N. Meller

[57] ABSTRACT

A thermostatic oven having an oven body with a front opening having a door which comprises windable sheets which cover the front opening with a space therebetween to close the same and which are wound up when the front opening is to be opened.

13 Claims, 4 Drawing Sheets

THEMOSTATIC OVEN

BACKGROUND OF THE INVENTION

1. Field of the Invention

The present invention relates to a thermostatic oven. More particularly, it relates to a door for opening or closing a front opening of the thermostatic oven.

2. Description of the Related Art

In a conventional thermostatic oven, a front opening thereof is usually opened or closed by a rotatable or slidable door with a rigid door panel.

In a thermostatic oven with a rotatable door, a relatively large space is needed in front of the front opening of the oven to enable the door to rotate and thus open or close the front opening. The need for such a relatively large space in front of the front opening of the oven makes it difficult to realize a simple and compact combination with the thermostatic oven of an automatic apparatus for feeding and discharging articles, parts or other objects into or from the thermostatic oven.

On the other hand, in a thermostatic oven with a slidable door, the area occupied by the oven must be enlarged, since space is needed for the door panel when the door is opened. This is wasted space, since it cannot be used for other purposes even when the oven door is closed.

SUMMARY OF THE INVENTION

The primary object of the present invention is to eliminate the drawbacks mentioned above by providing a thermostatic oven having a door which is composed of slidable and windable sheet(s) which can be wound up when the door is opened, thus reducing the space needed to accommodate the door when opened.

With the arrangement mentioned above, a large space in front of the front opening of the oven or in the oven, for receiving the door when opened is not necessary, and accordingly, an apparatus for an automatic feeding and discharging of objects into and from the oven can be arranged in close proximity to the oven, and operate in combination therewith.

To achieve the above object, according to the present invention, there is provided a thermostatic oven with a front opening having a door comprising at least one windable sheet which can be wound or unwound in order to open and close the front opening of the thermostatic oven.

Preferably, the door sheet is made of a material having a high resistance to heat, so that the door is not deformed or damaged when subjected to heat.

BRIEF DESCRIPTION OF THE DRAWINGS

The invention will be described below in detail with reference to the accompanying drawings, in which.

DESCRIPTION OF THE PREFERRED EMBODIMENT

Figure 1:
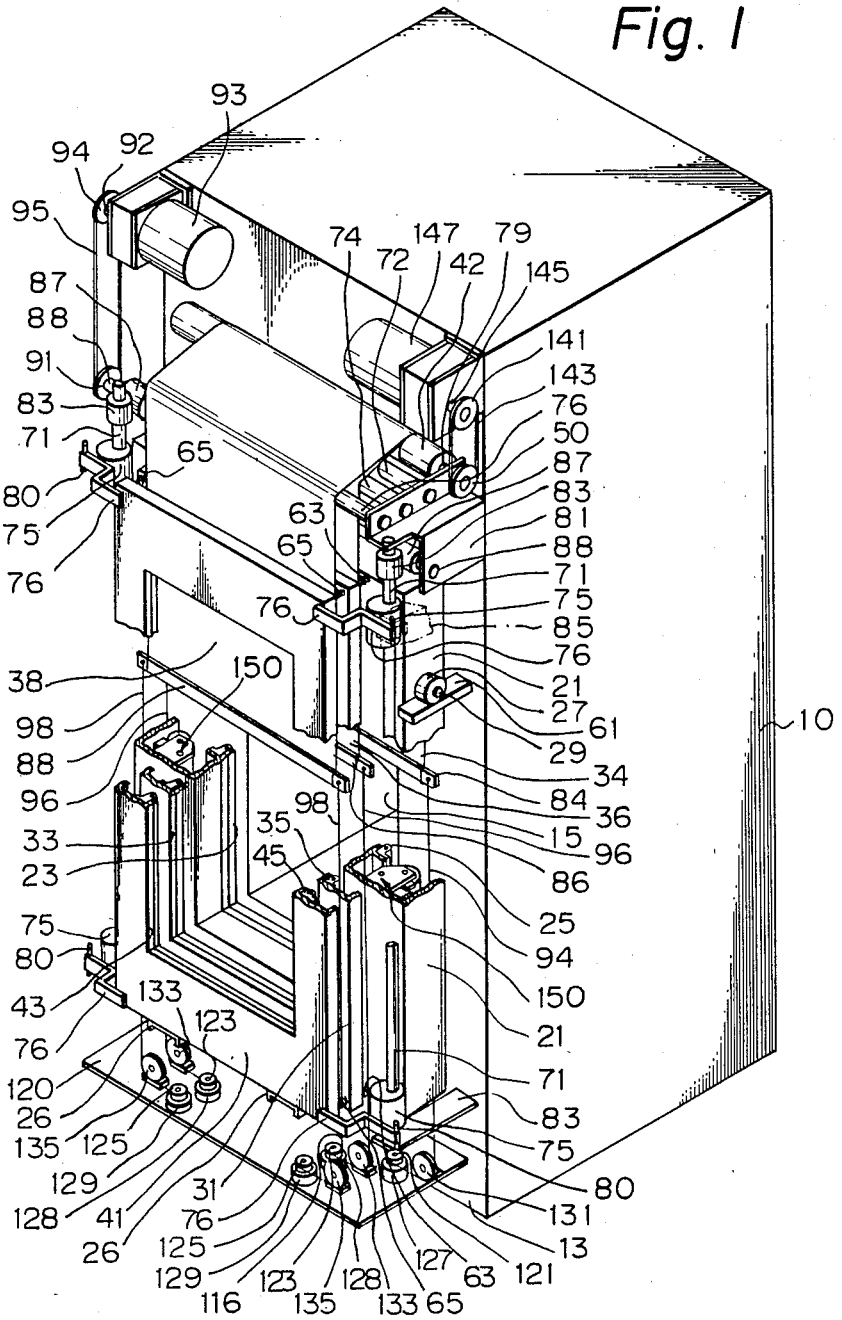
FIG. 1 is a partially broken perspective view of a thermostatic oven according to the present invention.
Figure 2:
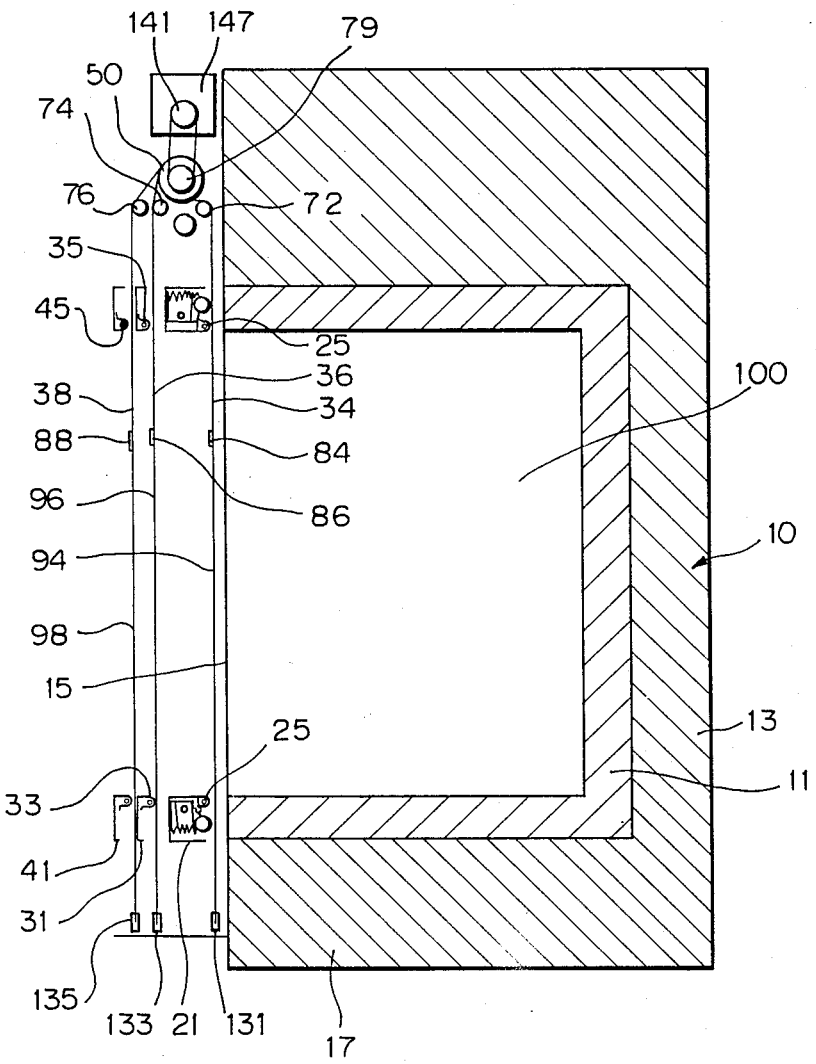
FIG. 2 is a longitudinal sectional view of a thermostatic oven shown in FIG. 1.

As shown in FIGS. 1 and 2, the thermostatic oven of the present invention has a hollow body 10 having an inner housing 11, and an outer housing 13 surrounding the inner housing 11 to protect and reinforce the same.

The inner housing 11 defines therein a thermostatic chamber 100 in which a heater unit and/or cooling unit and a fan, etc., (not shown) are provided to control the temperature in the thermostatic chamber to a required value. The thermostatic chamber 100 has a front opening 15 through which objects, such as electronic units or parts or the like (not shown) can be introduced to the thermostatic chamber 100. According to the present invention, the front opening 15 is closed by a door comprised of windable sheet(s), as will be described in detail hereinafter.

On the front end face of the oven body 10 is provided a first movable sheet-holding frame 21 (hereinafter referred to as the first frame) having an opening 23 substantially corresponding to the shape of the front opening 15 of the body 10, and able to move into contact with and away from the front edge 17 (FIG. 2) of the inner housing 11; a second movable sheet holding frame 31 (hereinafter referred to as the second frame) having an opening 33 substantially identical to the first opening 23 of the first frame 21 provided in front of the first frame 21 and able to move into contact with and away from the first frame 21; and, a third movable sheet holding frame 41 (hereinafter referred to as the third frame) having an opening 43 substantially identical to the first opening 23 provided in front of the second frame 31 and able to move into contact with and away from the second frame 31. In the illustrated embodiment, three sheet holding frames 21, 31, and 41, which are all in the form of annular rectangular frames when viewed from front, are provided, but this number of frames is not limited and more than or less than three frames can be provided.

The first frame 21 is provided with a cushion pad 25 on the end face thereof and facing the front edge 17 of the inner housing 11, to press a first door panel sheet 51, which extends between the first frame 21 and the front edge 17 of the inner housing 11, against the front edge 17 of the inner housing 11 in order to seal the front opening 15 of the body 10, as described hereinafter.

The second and third frames 31 and 41 are also provided with cushion pads 35 and 45 on the end faces thereof and facing the first and second frames 21 and 31, respectively, to press second and third door panel sheets 53 and 55, which extend between the first and second frames 21 and 31 and between the second and third frames 31 and 41, respectively, against the first and second frames 21 and 31 to seal the openings 23 and 33, respectively.

The cushion pads 25, 35 and 45 of the first, second, and third frames 21, 31, and 41 can be made of an elastic material, such as rubber or sponge or the like.

The first frame 21 is movably supported by guide plates 61 provided on the front end face of the outer housing 13 and projecting therefrom in a direction perpendicular to the front end face of the outer housing 13. Namely, the first frame 21 has rollers 27 mounted on opposite side faces thereof, and these rollers 27 are rotatably supported by shafts 29 secured to the first frame 21 and roll on the guide plates 61, so that the first frame 21 moves on the guide plates 61 to move close to and away from the front edge 17 of the inner housing 11.

The second and third frames 31 and 41 are slidably supported on parallel common guide rails 26 provided on and extending from the bottom of the first frame 21. Between the first and second frames 21 and 31 and between the second and third frames 31 and 41 are provided compression springs 63 and 65, which are located, for example, at the four corners of the associated frames, to maintain the gaps between the first and second frames 21 and 31 and between the second and third frames 31 and 41 at a predetermined distance, respectively.

In front of the first frame 21 and on opposite sides of the second and third frames 31 and 41 are provided two parallel rotational shafts 71 extending in parallel with the length of the frames 21, 31, and 41 and having a plurality of eccentric roller cams 75 mounted thereon, respectively. The roller cams 75 rotate together with the respective shafts 71, which are rotatably supported by upper and lower brackets 81 and 83 formed integrally with the oven body 10, for example, with the outer housing 13.

Note, a plurality of at least more than two eccentric roller cams 75 are provided on each of the rotational shafts 71 along the axis thereof.

The upper ends of the shafts 71 are rotatably supported by the upper right and left brackets 81 (only the upper right bracket 81 is shown) formed integrally with the oven body 10. Similarly, the lower ends of the shafts 71 are rotatably supported by the lower right and left brackets 83 (only the lower right bracket 83 is shown) also formed integrally with the oven body 10.

On the upper and lower ends and, if necessary, on the intermediate portions, of the opposite sides of the third frame 41 are provided swing levers 76 having at one end thereof rotational shafts 80 which are rotatably supported by respective brackets 85 (only one bracket 85 is shown in FIG. 1) secured to the oven body 10. The opposite ends of the swing levers 76 are pressed against the outer surfaces of the third frame 41 by tension springs 82 (FIGS. 4A and 4B) provided between the swing levers 76 and the first frame 21. The swing levers 76 are made to continuously bear against the respective eccentric roller cams 75 by the tension springs 82, so that the swing levers 76 rotate about the shafts 80 when the eccentric cam rollers 75 rotate.

At the upper ends of the shafts 71 are mounted gears 83 which mesh with corresponding gears 87. In the illustrated embodiment, since the gears 87 are mounted on a common drive shaft 88, which is rotatably supported by the upper brackets 81 and which extends perpendicularly to the shafts 71, both the gears 83 and 87 are bevel gears, and thus can engage with each other.

At one end of the drive shaft 88 is mounted a sprocket wheel 91, which is operatively connected to a sprocket wheel 94 mounted on an output shaft 92 of a drive motor 93 supported on the oven body 10, through a chain 95 which is wound around the sprocket wheels 91 and 94, so that the drive shaft 88 can be rotated by the motor 93.

According to the present invention, a plurality of flexible sheets 34, 36, and 38, which form door panels for opening and closing the front opening 15, are provided in front of the front opening 15. The sheets 34, 36 and 38 are made of a flexible material having a high heat resistance and flexibility, such as carbonized organic fiber, glass wool or ceramic fiber or the like, so that the sheets are not deformed or damaged when subjected to a high temperature or a low temperature. Note the sheets must be thin enough to be wound up.

The windable sheets 34, 36, and 38 are connected to a common winding roller 42, which is rotatably supported by the upper brackets 81, and the sheets 34, 36, and 38 are wound up by the common winding roller 42. The first sheet 34 extends between the opening 15 of the oven body 10 and the first frame 21, the second sheet 36 extends between the first frame 21 and the second frame 31, and the third sheet 38 extends between the second frame 31 and the third frame 41, respectively. The sheets 34, 36, and 38 are guided into position and separated by idle rollers 72, 74, and 76 which are rotatably supported by the upper brackets 81, in the vertical direction. Alternatively, the idle rollers 72, 74 and 76 can be replaced with non-rotatable bars.

The sheets 34, 36, and 38 are provided with reinforcement plates 84, 86, and 88 at the lower ends thereof and integral therewith, and connecting wires 94, 96, and 98 are connected to the opposite ends of the reinforcement plates 84, 86, and 88. The other ends of the connecting wires 94, 96 and 98 are connected to winding sprocket wheels 121, 123, and 125 rotatably supported on a supporting plate 120 secured to the oven body 10, through direction changing pulleys 131, 133, and 135, respectively.

The shafts of the winding sprocket wheels 121, 123, and 125 are connected to springs, such as hairsprings 127, 128, and 129, so that the winding sprocket wheels 121, 123 and 125 are biased in one direction of rotation in which the connecting wires 94, 96, and 98 are pulled downward to bring the door panel sheets 34, 36, and 38 to the closed position, in which the sheets 34, 36, and 38 are positioned in front of and covering the front opening 15 of the oven body 10, respectively.

The winding roller 42 is provided with a sprocket wheel 50 fixed to a shaft 79 thereof which is connected to a sprocket wheel 141 secured to a drive shaft 145 of a drive motor 147, which is supported on the oven body 10, by means of a chain 143, so that the winding roller 42 can be rotated by the motor 147.

Figure 3:
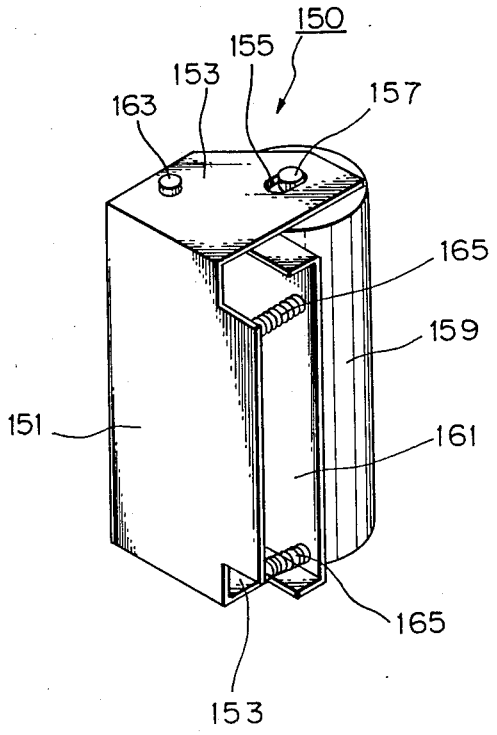
FIG. 3 is a perspective view of a sheet tensioning device of a thermostatic oven shown in FIG. 1; and, FIGS. 4A and 4B are cross sectional views of a sheet tensioning device shown in FIG. 3, shown in an operative position and an inoperative position, respectively.
Figure 4A:
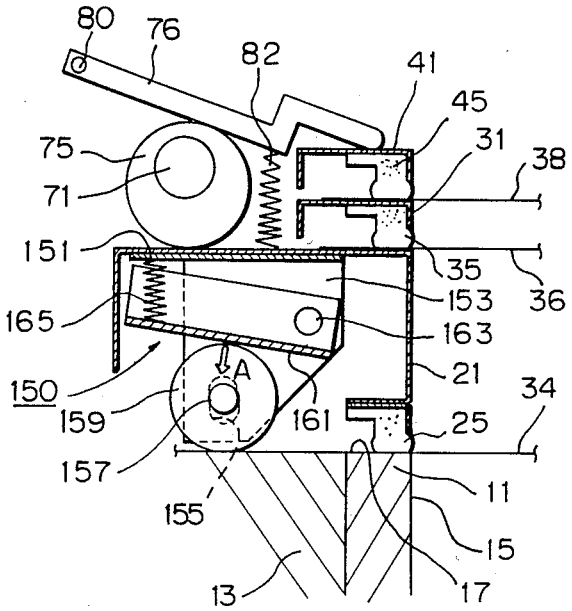
Figure 4B:
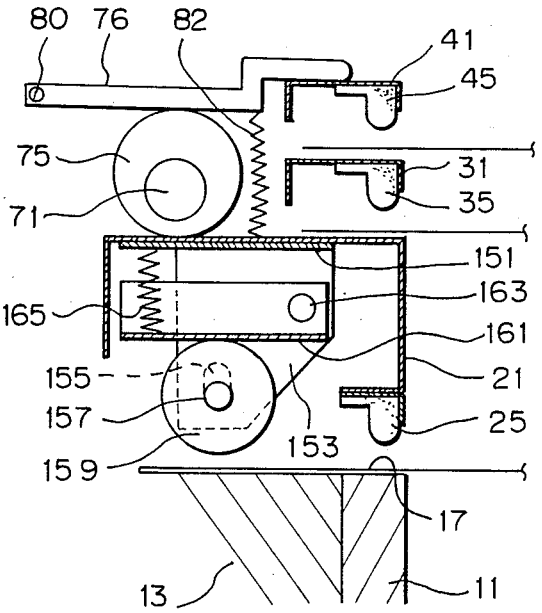

According to the present invention, a sheet tensioning device 150 is provided in the first frame 21, as can be seen from FIGS. 3, 4A, and 4B. The sheet tensioning device 150 comprises a base plate 151 with flanges 153 which are provided with elongated holes 155 in which shafts 157 of a roller 159 are movably fitted. The base plate 151 has a movable plate 161 which is pivoted by pivot pins 163 to the flanges 153 of the base plate 151 and which is continuously biased by springs 165 provided between the movable plate 161 and the base plate 151, so that the movable plate 161 is pressed against the roller 159. Preferably, four sheet tensioning devices 150 are provided at four corners of the first frame 21, so that the base plates 151 are secured to the inner face of the first frame 21 at the four corner portions thereof, in a symmetrical arrangement.

In FIG. 4A, the first, second, and third frames 21, 31, and 41 are located in an operative position, in which the first frame 21 is in contact with the front edge 17 of the inner housing 11 of the body 10 through the first sheet 34, so that the first sheet 34 is pressed against the front edge 17 of the inner housing 11 by the cushion pad 25 of the first frame 21 to seal the front opening 15 of the oven body 10. Also, in the operative position, the second and third frames 31 and 41 come into contact with the first and second frames 21 and 31, through the second and third sheets 36 and 38, respectively. Namely, the second and third sheets 36, 38 are pressed against the first and second frames 21, 31 by the cushion pads 35 and 45 to seal the spaces between the first and second frames 21, 31 and between the second and third frames 31, 41, respectively. The spaces between the first and second frames 21 and 31 and between the second and third frames 31 and 41 serve as heat insulator or adiabatic spaces. Also, in the operative position mentioned above, the rollers 159 of each of the sheet tensioning devices 150 are pressed against the front edge of the outer housing 13 of the oven body 10 through the first sheet 34 to give an outward tensile force to the first sheet 34, as will be discussed hereinafter.

In FIG. 4B, the first, second, and third frames 21, 31, and 41 are located in an inoperative position in which the first frame 21, the second frame 31, and the third frame 41 are separated from the front edge 17 of the inner housing 11, the first frame 21, and the second frame 31, respectively, so that the first, second, and third sheets 34, 36, and 38 move away from the front edge 17, the first frame 21, and the second frame 31, respectively. Also, in the inoperative position shown in FIG. 4B, the rollers 159 of the sheet tensioning devices 150 move away from the first sheet 34.

The thermostatic oven of the present invention operates as follows.

When the front opening 15 of the oven is opened, the motor 93 is automatically or manually made ON by a switch (not shown) to rotate in one direction, and the shafts 71 are rotated by the motor through the chain 95 and the gears 87 and 83, so that the eccentric roller cams 75 rotate together with the shafts 71 to occupy the inoperative position shown in FIG. 4B. As a result, the first frame 21 separates from the first sheet 34, and the second and third frames 31 and 41 separate from the first and second frames 21 and 31, so that the sheets 34, 36, and 38 are free to move. The motor 147 is then automatically or manually made ON by a switch (not shown) to rotate in one direction, the winding roller 42 is rotated through the chain 143 and the sprocket wheel 50, and by the rotation of the winding roller 42, the sheets 34, 36, and 38 are wound up by the winding roller 42 against the spring force of the springs 127, 128, and 129 to open the front opening 15 of the oven 10, and the openings 23 and 33 of the first and second frames 21 and 31, respectively. Note that the opening 43 of the third frame 41 is always open.

On the other hand, when the front opening 15 of the oven is to be closed, after the articles to be worked are placed in the oven 10 through the front opening 15 thereof, the motor 93 is made ON to rotate in the reverse direction and thus rotate the winding roller 42 in the opposite direction. Consequently, the sheets 34, 36, and 38, which have been wound up by the winding roller 42, are pulled down and unwound by the springs 127, 128 and 129 through the respective wires 94, 96, and 98, respectively. As a result, the first sheet 34 closes the front opening 15 of the oven 10 and the second and third sheets 36 and 38 close the openings 23 and 33 of the first and second frames 21 and 31, respectively. The motor 93 is then made ON to rotate in the reverse direction, to rotate the shafts 71, and accordingly, the eccentric roller cams 75, in the opposite direction, so that the eccentric roller cams 75 push the first frame 21 toward the first sheet 34 to bring the cushion pad 25 in contact with the front edge 17 of the inner housing 11 through the first sheet 34 and thus press the sheet 34 against the front edge 17, to seal the front opening 15 of the oven 10. At the same time, the rotation of the eccentric cams 75 causes the swing levers 76 to rotate about the shafts 80, to press the third frame 41 and the second frame 31 onto the second frame 31 and the first frame 21, against the springs 63 and 65 provided between the first and second frames 21 and 31 and between the second and third frames 31 and 41, respectively, with the help of the springs 82 provided between the first frame 21 and the swing levers 76, as shown in FIG. 4A. As a result of the swing movement of the swing levers 76, the cushion pads 35 and 45 of the second and third frames 31 and 41 are brought into contact with and press against the first and second frames 21 and 31 through the second and third sheets 36 and 38, to seal the spaces between the first and second sheets 34, 36 and between the second and third sheets 36, 38, respectively. Thus, the front opening 15 of the oven 10 is closed by the three sheets 34, 36 and 38. The spaces between the first and second sheets 34, 36 and between the second and third sheets 36, 38 contribute to an increase of the thermostatic efficiency of the oven 10 of the present invention, since these spaces serve as adiabatic spaces, as mentioned before.

It should be noted that, when the eccentric roller cams 75 rotate in the opposite direction to push the first frame 21, as mentioned above, the sheet tensioning devices 150 are also actuated by the eccentric cams 75. Namely, the downward movement of the first frame 21 in FIG. 4A causes the base plates 151 of the sheet tensioning devices 150 to move in the same direction, i.e., downward in FIG. 4A, so that the rollers 159 come into contact with and press against the front edge of the outer housing 13 through the first sheet 34. Further downward movement of the first frame 21 after the contact of the rollers 159 with the outer housing through the first sheet 34 causes a slight upward movement of the rollers 159 due to the elongated holes 155 in which the pins 157 of the rollers 159 are movably fitted, by a displacement determined by the length of the elongated holes 155, while pushing the movable plates 161 of the sheet tensioning device 150 upward against the springs 165, as shown in FIG. 4A.

Namely, the movable plates 161 rotate in the clockwise direction in FIG. 4A about the respective shafts 163 to compress the springs 165. The compressed springs 165 continuously press the rollers 159 through the movable plate 161 against the first sheet 34 on the outer housing of the oven body 10, in the direction shown by an arrow A in FIG. 4A. The direction A is normal to the plane of the movable plates 161 of the sheet tensioning devices 150, which are now inclined with respect to the plane of the first sheet 34. Namely, the first sheet 34 is subject to an outward pushing force (wedge effect) by the rollers 159 at the four corner portions thereof, so that the sheet 34 is under an outward tension.

Generally speaking, the first sheet 34 which closes the front opening 15 of the oven 10 is subject to an internal pressure, and accordingly, the sheet 34 tends to move toward the second sheet 36. This tendency can be effectively prevented by the wedge effect of the rollers 159 as mentioned above.

In the illustrated embodiment, although the sheets are wound upward in the vertical direction by the winding roller, it is also possible to wind the sheets downward in the vertical direction by providing a winding roller on the lower portion of the oven body. Alternatively, it is also possible to wind the sheets laterally, i.e. in the horizontal direction. In this alternative, the winding roller can be provided on right or left side of the oven body when viewed from the front.

It should be noted that the number of sheets is not limited to three, as in the above mentioned embodiment, and can be more than or less than three. Accordingly, it is obvious that the number of frames having openings corresponding to the front opening of the oven body and the associated sheet opening and closing mechanisms are increased or decreased in accordance with the number of sheets.

As mentioned before, an increased number of sheets forming the door panels will enhance the heat insulation effect of the oven.

It is possible to coat the surfaces of the sheets adjacent to the oven body with a heat reflecting layer, such as aluminum, in order to increase the heat insulation of the oven.

Alternatively, it is possible to bend the direction of the first sheet in a direction opposite to that of the second and third sheets, as can be seen from FIG. 2, in view of the geometrical arrangement of the associated circumferential components. In this alternative, the first sheet 34 is bent by the roller 72 in the direction opposite to the direction of the other two sheets 36, 38.

As can be seen from the foregoing, according to the present invention, since at least one windable sheet is provided in front of the front opening of the thermostatic oven to open or close the front opening, an additional space for accommodating the sheet when opened, or for enabling the opening movement of the sheet, is not necessary. This makes it possible not only to realize a compact and small thermostatic oven but also to provide an apparatus for the automatic feeding and discharging of articles to be introduced to the oven, in close proximity to and in combination with the thermostatic oven.

I claim:

1. A thermostatic oven having an oven body with a front opening having a door which comprises at least one windable sheet which covers the front opening and is wound or unwound to open and close said front opening; means located on the oven body for winding and unwinding the windable sheet; wherein said winding means comprises a rotatable winding roller to which one end of the windable sheet is connected to wind and unwind the windable sheet by the rotation of the winding roller; means located on the oven body for actuating the rotatable winding roller, and further comprising means for pressing the windable sheet against the oven body when the front opening is closed by the windable sheet wherein said pressing means comprises a movable frame having an opening corresponding to the front opening for pressing a peripheral edge of the windable sheet against the oven body to seal the front opening when the front opening is closed by the windable sheet.

2. A thermostatic oven according to claim 1, further comprising means for actuating the frame between an operative position in which the frame is in contact with the oven body through the windable sheet and an inoperative position in which the frame is separated from the oven body.

3. A thermostatic oven according to claim 2, further comprising means for tensioning the windable sheet when said sheet is pressed onto the oven body by the frame when located in the operative position.

4. A thermostatic oven according to claim 3, wherein said sheet tensioning means comprises a pressing roller which is associated with the frame and which is elastically biased when the frame is brought into the operative position.

5. A thermostatic oven according to claim 4, wherein said sheet tensioning means comprises a spring which biases the pressing roller onto the oven body through the windable sheet in a direction in which the windable sheet is subject to an outward force to extend the windable sheet outward.

6. A thermostatic oven according to claim 2, wherein said means for actuating the frame between the operative and inoperative positions comprises eccentric rollers which bear against the frame and which rotate to move the frame between the operative and inoperative position.

7. A thermostatic oven according to claim 6, further comprising means for rotating the eccentric rollers.

8. A thermostatic oven according to claim 2, wherein said frame has a cushion member which is in contact with the oven body through the windable sheet when the frame is located in the operative position.

9. A thermostatic oven according to claim 1, wherein said windable sheet has at least one connecting wire which is connected to one end of the windable sheet, the other end the sheet being connected to the winding means, said connecting wire being connected to a spring which continuously biases the windable sheet into a position in which the windable sheet closes the front opening.

10. A thermostatic oven having an oven body with a front opening, comprising a door which comprises a plurality of windable sheets which are located in front of the front opening with a predetermined space therebetween and which are wound up when the front opening is opened, a plurality of frames corresponding to the windable sheets, each of said frames having an opening corresponding to the front opening of the oven body, the spaces between the sheets defining heat insulation spaces, said sheets being connected at one end to a rotatable winding roller provided on the oven body and at the opposite ends to connecting wires which are connected to springs to bias the respective sheets to a closed position in which the front opening is closed by the sheets.

11. A thermostatic oven according to claim 10, further comprising means for actuating the frames towards and away from the oven body at one time.

12. A thermostatic oven according to claim 11, wherein said windable sheets extend between the frame closest to the oven body and the oven body and between the adjacent frames.

13. A thermostatic oven according to claim 11, wherein said frames move between an inoperative position in which said sheets are separated from each other and an operative position in which the frame which is located closest to the oven body presses on the oven body through the windable sheet therebetween and the remaining frames are in contact with the adjacent frames through the windable sheets therebetween.

* * * * *